United States Patent [19]

Anderson

[11] 4,102,510

[45] Jul. 25, 1978

[54] ROLL HOLDER MEANS

[76] Inventor: James Ralph Anderson, 4030 Cliffdale, Memphis, Tenn. 38127

[21] Appl. No.: 820,752

[22] Filed: Aug. 1, 1977

[51] Int. Cl.[2] ..... B65H 19/00

[52] U.S. Cl. ..... 242/55.2

[58] Field of Search ..... 242/55.2, 55.3, 55.53, 242/55.54, 55.55

[56] References Cited

U.S. PATENT DOCUMENTS

| | | | |
|---|---|---|---|
| 960,363 | 6/1910 | Marshall | 242/55.2 |
| 2,619,297 | 11/1952 | Sharrer | 242/55.3 |
| 3,038,677 | 6/1962 | Schermerhorn | 242/55.3 |

*Primary Examiner*—Edward J. McCarthy
*Attorney, Agent, or Firm*—John R. Walker, III

[57] ABSTRACT

A device for holding a roll of toilet tissue or the like and for being fixedly attached to a wall or the like in such a manner that unauthorized removal of the device from the wall is effectively prevented. The device includes a base for being attached to the wall by one or more screws or the like and includes a pair of arm members and a bar member for being fixedly and lockably attached to one another and to the base in such a manner that the arm members completely cover the heads of the screws to thereby prevent access to the heads of the screws when the bar member and arm members are locked in place thereby preventing unauthorized removal of the device from the wall. The bar member extends completely through the roll of toilet tissue so that when the bar member and the arm members are locked in place, the roll of toilet tissue cannot be removed from the device.

9 Claims, 16 Drawing Figures

ROLL HOLDER MEANS

BACKGROUND OF THE INVENTION

1. Field of the Invention

This invention relates generally to holders for rolls of paper and the like and more specifically to such holders which are adapted to prevent theft.

2. Description of the Prior Art

Heretofore, various devices for holding rolls of paper and the like adapted to prevent theft of the rolls or of the devices themselves have been developed. See, for example, Spooner et al., U.S. Pat. No. 516,235; Marshall, U.S. Pat. No. 960,363; Walker, U.S. Pat. No. 1,128,560; Duby, U.S. Pat. No. 1,888,426; and Agamaite, U.S. Pat. No. 2,410,328. None of the above patents disclose or suggest the present invention.

All known prior devices for holding rolls of toilet tissue and the like are disadvantageous in that none effectively prevents theft of the rolls and/or of the devices themselves. For example, while the Spooner, Marshall, Duby and Agamaite roll holders all include means for preventing unauthorized removal of the rolls from the holders, the holders themselves may be unauthorizedly removed from the walls by merely removing the easily accessible fastener members from the walls. The fixture lock of Walker, while making it more difficult to remove fixtures such as roll holders from a wall, does not completely overcome the problem since a determined thief need only obtain a substantially flat, elongated member such as a knife or the like to deactivate the lock.

SUMMARY OF THE INVENTION

The present invention is directed towards overcoming the problems and disadvantages of prior holder means for holding a roll of toilet tissue or the like to a supporting surface such as a wall. The concept of the present invention is to provide means for holding a roll and for being fixedly attached to a supporting surface in such a manner that unauthorized removal of the means from the supporting surface is prevented.

The holder means of the present invention includes, in general, a base means having at least one aperture therethrough for allowing a portion of a fastening member such as a screw to extend therethrough to fixedly attach the base member to a supporting surface such as a wall; a first arm member; a second arm member; a bar member for extending through the roll; and an attachment means for fixedly attaching the bar member and the first and second arm members together and for fixedly attaching the first and second arm members to the base means with one of the arm members completely covering the aperture through the base means through which a portion of the screw extends to prevent access to the screw head when the bar member and first and second arm members are fixed in place thereby preventing unauthorized removal of the holder means from the wall.

DESCRIPTION OF THE PREFERRED EMBODIMENT

Figure 2:
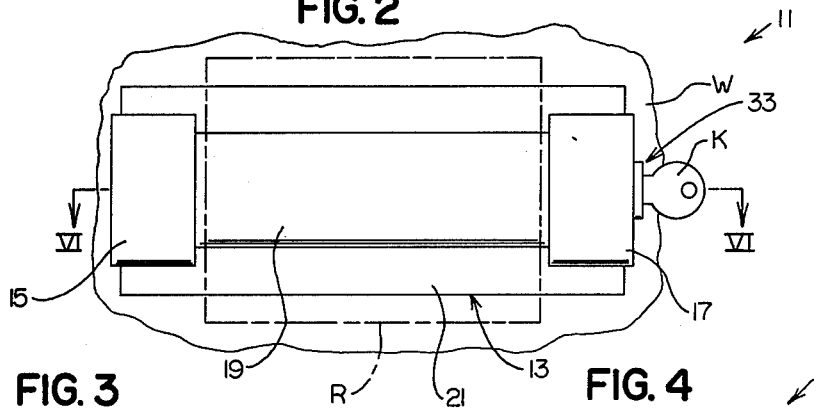
FIG. 2 is a front elevational view thereof shown attached to a wall.
Figure 3:
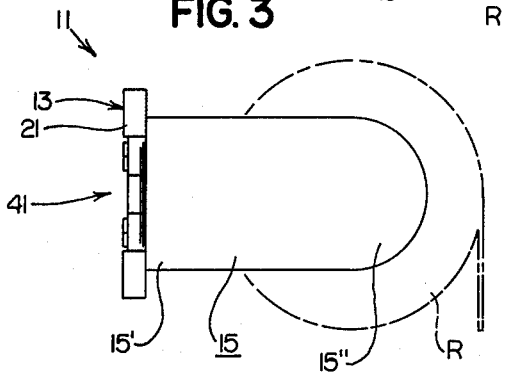
FIG. 3 is a left side elevational view thereof.
Figure 4:
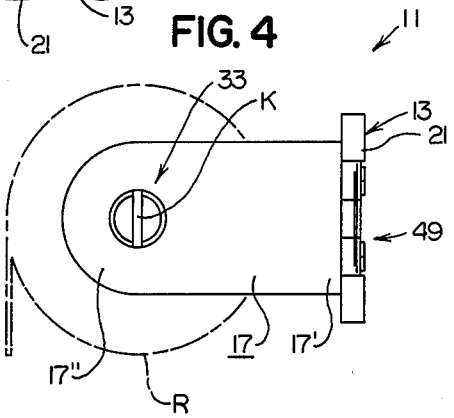
FIG. 4 is a right side elevational view thereof.
Figure 5:
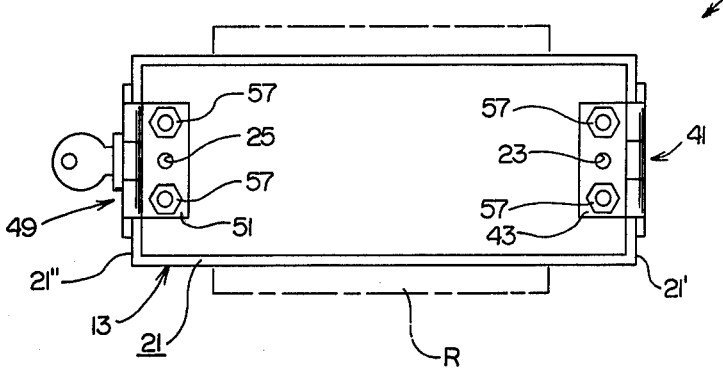
FIG. 5 is a rear elevational view thereof.
Figure 16:
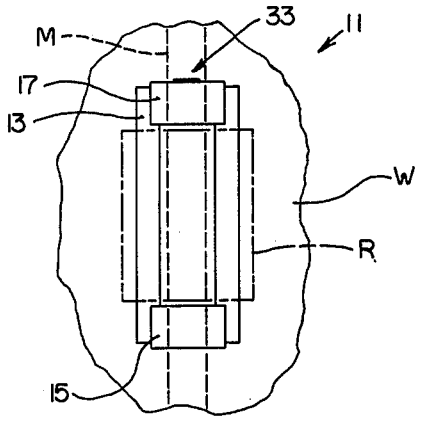
FIG. 16 is a front elevational view of the holder means of the present invention substantially like FIG. 2 but with the holder means rotated substantially 90°.

The holder means 11 of the present invention is for holding a roll such as a roll R of toilet tissue or the like and is for being attached to a supporting surface such as a wall W by at least one fastening member such as the pair of screws S (see, in general, FIGS. 2 and 16). The holder means 11 includes, in general, a base means 13, a first arm means 15, a second arm means 17, a bar means 19, and an attachment means for fixedly attaching the bar member 19 and the first and second arm means 15, 17 together and for fixedly attaching the first and second arm member 15, 17 and the base means 13 together. All components of the holder means 11 are made of a substantially nonbreakable material such as metal.

Figure 15:
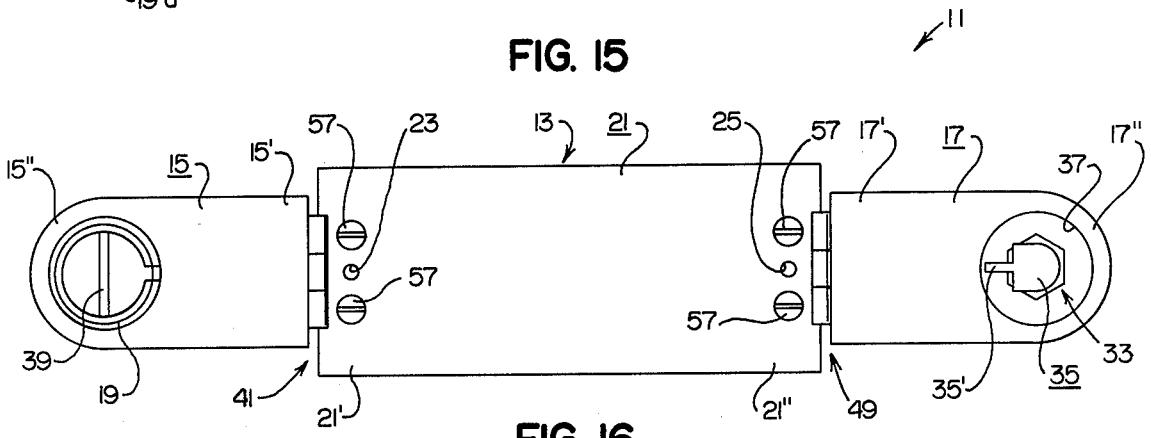
FIG. 15 is a front elevational view of FIG. 14.

The base means 13 preferably includes a substantially rectangular plate member 21 having a first end 21' and a second end 21" (see, in general, FIG. 15). An aperture 23 is preferably provided through the first end 21' of the plate member 21. Likewise, a second aperture 25 is preferably provided through the second end 21" of the plate member 21. The apertures 23, 25 allow portions of the screws S to extend therethrough to fixedly attach the plate member 21 to the wall W in a manner which should now be apparent to those skilled in the art (see, in general, FIGS. 6–8).

Figure 6:
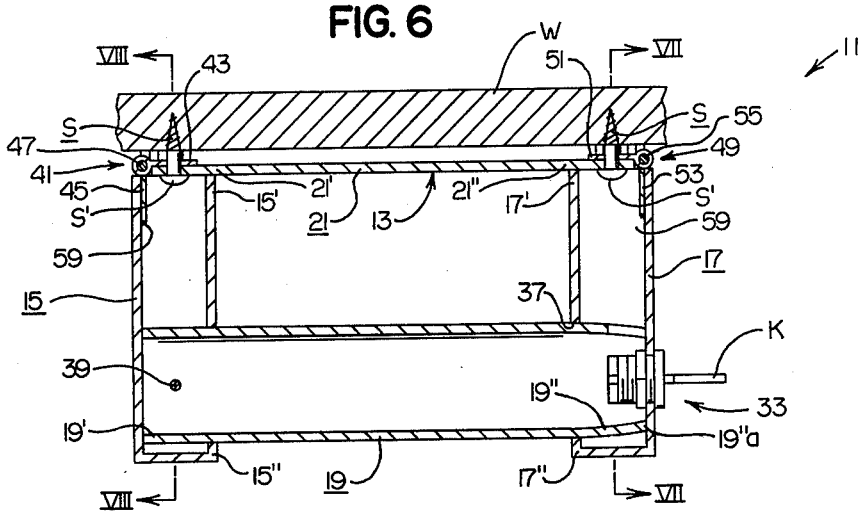
FIG. 6 is a sectional view thereof as taken on line VI—VI of FIG. 2.
Figure 8:
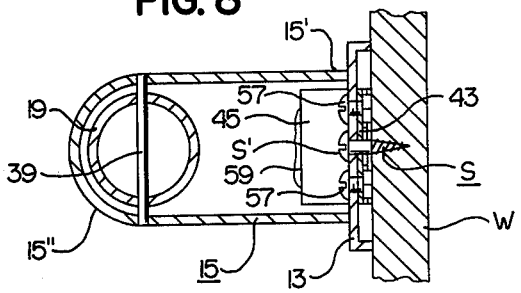
FIG. 8 is a sectional view thereof as taken on line VIII—VIII of FIG. 6.

The first arm member 15 has a first end 15' and a second end 15" (see, in general, FIGS. 6 and 8). The first end 15' is adapted to selectively completely cover the aperture 23 through the first end 21' of the plate member 21 for preventing unauthorized access to the head S' of the screw S which extends through the aperture 23.

Figure 7:
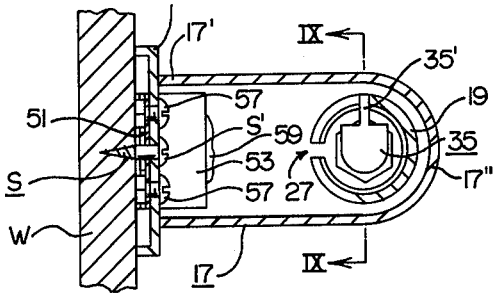
FIG. 7 is a sectional view thereof as taken on line VII—VII of FIG. 6.

The second arm member 17 has a first end 17' and a second end 17" (see, in general, FIGS. 6 and 7). The first end 17' is adapted to selectively completely cover the aperture 25 through the second end 21" of the plate member 21 for preventing unauthorized access to the head S' of the screw S which extends through the aperture 25.

Figure 1:
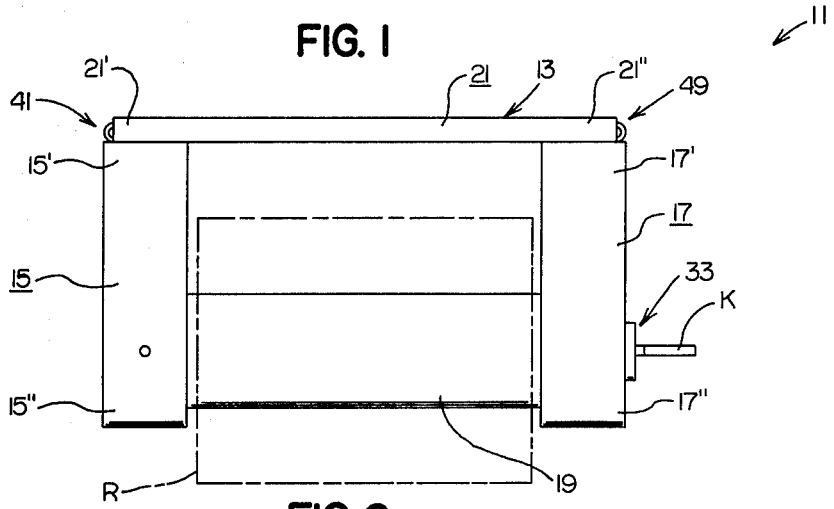
FIG. 1 is a top plan view of the holder means of the present invention shown holding a roll of paper.
Figure 13:
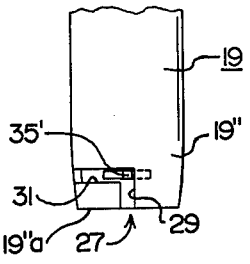
FIG. 13 is a top plan view substantially of FIG. 11.

The bar member 19 is elongated for extending completely through the roll R of toilet tissue or the like (see, in general, FIG. 1, 2 and 16). The bar member 19 has a first end 19' for being fixedly attached to the second end 15" of the first arm member 15 and has a second end 19" for being lockably attached to the second end 17" of the second arm member 17 (see, in general, FIG. 6). The second end 19″ of the bar member 19 has a notch 27 therein (see, in general, FIG. 13). The notch 27 has a first portion 29 extending from the outer edge 19″*a* of the second 19″ of the bar member along the longitudinal axis of the bar member 19 and towards the first end 19′ of the bar member 19. The notch 27 also has a second portion 31 extending transverse to and located in communication with the first portion 29 of the notch 27 at a location remote from the outer edge 19″*a* of the second end 19′ of the bar member 19.

Figure 9:
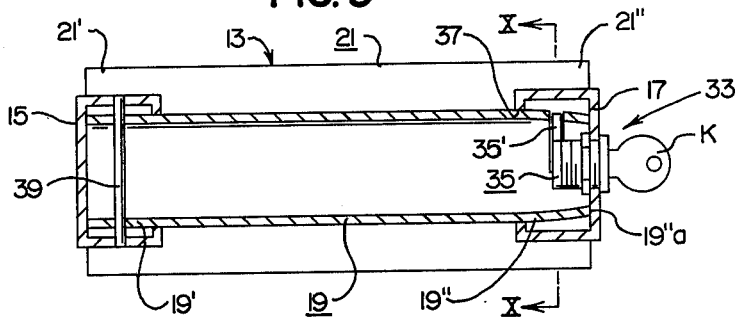
FIG. 9 is a sectional view thereof as taken on line IX—IX of FIG. 7.
Figure 10:
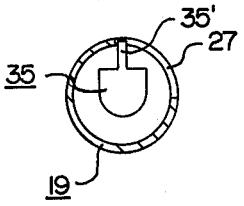
FIG. 10 is a sectional view thereof as taken on line X—X of FIG. 9 with some parts removed for clarity.
Figure 11:
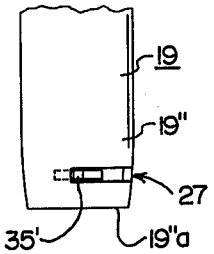
FIG. 11 is a top plan view substantially of FIG. 10.
Figure 12:
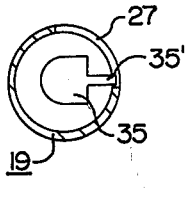
FIG. 12 is a sectional view substantially like FIG. 10 but certain portions thereof being in a moved position.

The attachment means preferably includes a standard lock means 33 of the type which requires a key such as a combination or an actual key K to be unlocked (see, in general, FIGS. 6 and 9). The lock means 33 is preferably attached to the second end 17″ of the second arm member 17 to lockably attach the second end 19″ of the bar member 19 to the second end 17″ of the second arm member 17. The lock means 33 includes a lock element 35 located in a socket 37 provided in the second end 17″ of the second arm member 17. The lock element 35 preferably has an arm-like portion 35′ of a size for extending into the notch 27 and which is positioned substantially transverse to the longitudinal axis of the bar member 19 when the first and second arm members 15, 17 and the bar member 19 are attached together. The lock element 35 is movable between an opened position for allowing the bar member 19 to be inserted into the socket 37 of the second arm member 17 with the first portion 29 of the notch 27 thereof receiving the lock element 35, and a locked position with the lock element 35 positioned within the second portion 31 of the notch 27 offset from the first portion 29 thereof for preventing the second end 19″ of the bar member 19 from being removed from the socket 37 of the second arm member 17.

The attachment means also includes means for fixedly attaching the first end 19′ of the bar member 19 and the second end 15″ of the first arm member 15 together. For example, the attachment means may include a pin member 39 for extending through both the first arm member 15 and the bar member 19 to fixedly attach the two members together (see, in general, FIGS. 8 and 9). It should be noted that the first arm member and bar member 19 may be fixedly attached together in a number of other ways apparent to those skilled in the art such as by welding the two members together.

The attachment means also includes means for fixedly attaching the first and second arm members 15, 17 to the plate member 21. For example, the holder means 11 may include a first hinge means 41 for pivotally attaching the first arm member 15 to the plate member 21 (see, in general, FIG. 6). The first hinge means 41 includes a first hinge plate 43 for being fixedly attached to the first end 21′ of the plate member 21, includes a second hinge plate 45 for being fixedly attached to the first end 15′ of the first arm member 15, and includes joining means for pivotally joining the first and second hinge plates 43, 45 together. The joining means preferably includes a pivot pin 47 for passing through portions of the first and second hinge plates 43, 45 to pivotally attach the two plates together. The holder means 11 may also include a second hinge means 49 for pivotally attaching the second arm member 17 to the plate member 21 (see, in general, FIG. 6). The second hinge means 49 includes a first hinge plate 51 for being fixedly attached to the second end 21″ of the plate member 21, includes a second hinge plate 53 for being fixedly attached to the first end 17′ of the second arm member 17, and includes joining means for pivotally joining the first and second hinge plates 51, 53 together. The joining means preferably includes a pivot pin 55 for passing through portions of the first and second hinge plates 51, 53 to pivotally join the two plates together.

The holder means 11 also preferably includes fixation means for fixedly attaching the first and second hinge plates 43, 45; 51, 53 of the first and second hinge means 41, 49 to the plate means 21 and to the first and second arm members 15, 17. The fixation means may consist of any means apparent to those skilled in the art for fixedly attaching the components together. For example, the components may be welded together and/or bolted together. In FIGS. 7 and 8, the first hinge plates 43, 51 of the first and second hinge means 41, 49 are fixedly attached to the plate member 21 by way of bolts 57, and the second hinge plates 45, 53 of the first and second hinge means 41, 49 are fixedly attached to the first and second arm members 15, 17 by way of welds 59. In any event, the first and second hinge means 41, 49 and the fixation means are preferably substantially completely covered by the base means 13 and/or the first and second arm means 15, 17 when the bar member 19 is lockably attached to the second arm member 17 to prevent unauthorized access thereto.

Figure 14:
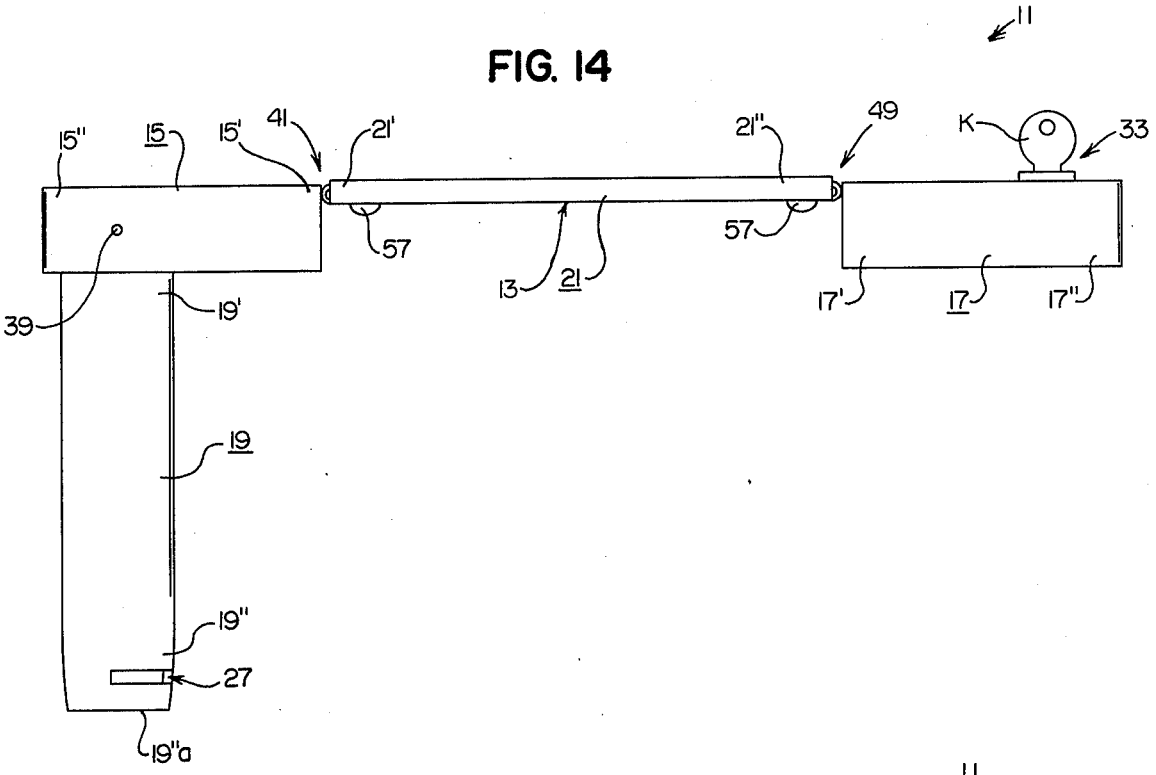
FIG. 14 is a top plan view of the holder means of the present invention in an opened, unlocked position.

To use the holder means 11, the first step is to attach the holder means 11 to the wall W. This is done with the holder means 11 in an opened position as shown in FIGS. 14 and 15. The holder means 11 may be attached to the wall W in a substantially horizontal position as shown in FIG. 2 or may be attached to the wall W in a substantially vertical position as shown in FIG. 16 in which case it may be attached to a single stud member M or the like of the wall W. Next, the roll R of toilet tissue or the like is inserted onto the bar member 19 and the first and second arm members 15, 17 are then pivoted towards one another causing the second end 19″ of the bar member 19 to be inserted into the socket 37 in the second end 17″ of the second arm member 17. Finally, the key K is turned causing the lock means 33 to fixedly lock the bar member 19 to the second arm member 17. The roll R can then be removed from the holder means 11 only by authorized persons having access to the key K and the holder means 11 can be removed from the wall W only by authorized persons having access to the key K.

Although the invention has been described and illustrated with respect to a preferred embodiment thereof, it is not to be so limited since changes and modifications may be made therein which are within the full intended scope of the invention.

I claim:

1. Holder means for holding a roll and for being fixedly attached to a supporting surface by at least one fastening member in such a manner that unauthorized removal of said holder means from the supporting surface is prevented, said holder means comprising:

(a) base means having at least one aperture therethrough for allowing a portion of the fastening member to extend therethrough to fixedly attach said base means to the supporting surface;

(b) a first arm member;

(c) a second arm member;

(d) a bar member for extending through the roll; and (e) attachment means for fixedly attaching said bar member and said first and second arm members together and for fixedly attaching said first and second arm members to said base means with one of said arm members completely covering said aperture through said base means through which a portion of the fastening member extends to prevent access to the fastening member when said bar member and said first and second arm members are fixed in place thereby preventing unauthorized removal of said holder means from the supporting surface.

2. The holder means of claim 1 in which said attachment means includes a lock means which requires a key to be unlocked.

3. The holder means of claim 2 in which said base means includes a substantially rectangular plate member having a first and a second end and having a first aperture through said first end to allow a portion of a first fastening member to extend therethrough to fixedly attach said first end to the supporting surface and having a second aperture through said second end to allow a portion of a second fastening member to extend therethrough to fixedly attach said second end to the supporting surface; in which said first arm member includes a first end and a second end, said first end of said first arm member selectively completely covering said first aperture through said plate member for preventing access to the first fastening member; in which said second arm member includes a first end and a second end, said first end of said second arm member selectively completely covering said second aperture through said plate member for preventing access to the second fastening member; and in which said bar member includes a first end for being fixedly attached to said second end of said first arm member and includes a second end for being lockably attached to said second end of said second arm member by said lock means.

4. The holder means of claim 3 in which said second arm member has a socket in said second end thereof for receiving said second end of said bar member.

5. The holder means of claim 4 in which is included a first hinge means for pivotally attaching said first arm member to said plate member, said first hinge means including a first hinge plate for being fixedly attached to said first end of said plate member, including a second hinge plate for being fixedly attached to said first end of said first arm member, and including joining means for pivotally joining said first and second hinge plates together; in which is included a second hinge means for pivotally attaching said second arm member to said plate member, said second hinge means including a first hinge plate for being fixedly attached to said second end of said plate member, including a second hinge plate for being fixedly attached to said first end of said second arm member, and including joining means for pivotally joining said first and second hinge plates together; and in which is included fixation means for fixedly attaching said first and second hinge plates of said first and second hinge means to said plate means and said first and second arm means.

6. The holder means of claim 5 in which said first and second hinge means and said fixation means are substantially completely covered by said base means and said first and second arm means when said bar member is lockably attached to said second end of said second arm member to prevent unauthorized access thereto.

7. The holder means of claim 4 in which said second end of said bar member has a notch therein, said notch having a first portion extending from the outer edge of said second end of said bar member along the longitudinal axis thereof towards said first end thereof and having a second portion extending transverse to and positioned in communication with said first portion at a location remote from said outer edge of said second end of said bar member; and in which said lock means includes a lock element movable between an opened position for allowing said bar member to be inserted into said socket of said second arm member with said first portion of said notch receiving said lock element, and a locked position for preventing said second end of said bar member from being removed from said socket of said second arm member with said second portion of said notch of said bar member receiving said lock element.

8. The combination with a wall and two screws of a holder means for holding a roll of toilet tissue, said holder means comprising:

(a) base means having a pair of apertures therethrough for allowing a portion of the pair of screws to extend therethrough to fixedly attach said base means to the wall;
(b) a first arm member;
(c) a second arm member;
(d) a bar member for extending through the roll of toilet tissue; and
(e) attachment means selectively fixedly attaching said bar member and said first and second arm members together and attaching said first and second arm members to said base means with each of said arm members completely covering each of said apertures through said base means through which a portion of the pair of screws extend to prevent access to the screws when said bar member and said arm members are fixed in place thereby preventing unauthorized removal of said holder means from the wall.

9. The combination of claim 8 in which said attachment means includes a lock means which requires a key to be unlocked.

* * * * *